United States Patent [19]

Kohler et al.

[11] 4,204,731

[45] May 27, 1980

[54] APPARATUS FOR ELECTROPHOTOGRAPHIC COPYING WITH MEANS FOR EFFECTING IMAGE PENETRATION THROUGH THE COPY CARRIERS

[75] Inventors: Robert Kohler, Wessling; Jörn Müller, Munich; Dieter Giglberger, Unterhaching; Freidrich Bestenreiner, Grünwald, all of Fed. Rep. of Germany

[73] Assignee: Agfa-Gevaert AG, Leverkusen, Fed. Rep. of Germany

[21] Appl. No.: 874,872

[22] Filed: Feb. 3, 1978

[30] Foreign Application Priority Data

Feb. 4, 1977 [DE] Fed. Rep. of Germany ..... 2704591

[51] Int. Cl.[2] ..... G03G 15/00

[52] U.S. Cl. ..... 355/16; 250/320; 355/3 R; 355/10

[58] Field of Search ..... 355/16, 3 R, 3 BE, 10, 355/11, 27, 66; 250/320

[56] References Cited

U.S. PATENT DOCUMENTS

| | | | |
|---|---|---|---|
| 2,968,553 | 1/1961 | Gundlach | 355/3 R |
| 3,654,654 | 4/1972 | Abreu et al. | 355/15 X |
| 3,697,160 | 10/1972 | Clark | 355/3 BE |
| 3,722,992 | 3/1973 | Zweig | 355/3 BE |
| 3,820,985 | 6/1974 | Gaynor et al. | 355/3 BE |
| 3,924,945 | 12/1975 | Weigl | 355/3 R |
| 4,039,344 | 9/1977 | Simpson | 355/3 R |

*Primary Examiner*—R. L. Moses

*Attorney, Agent, or Firm*—Michael J. Striker

[57] ABSTRACT

An electrostatic charge is applied to a charge carrier and the latter is thereupon contacted with one side of a sheet-material copy carrier. Thereafter, an original is imaged onto the charge carrier to produce thereon a latent electrostatic image field which penetrates the copy carrier, whereupon the latent image is developed on the copy carrier by contacting the other side thereof with developer material.

8 Claims, 4 Drawing Figures

APPARATUS FOR ELECTROPHOTOGRAPHIC COPYING WITH MEANS FOR EFFECTING IMAGE PENETRATION THROUGH THE COPY CARRIERS

BACKGROUND OF THE INVENTION

1. Field of the Invention

The present invention relates to electrophotographic copying.

More particularly, the invention relates to a method of, and an apparatus for, making electrophotographic copies of an original.

2. The Prior Art

In electrophotographic copiers a surface of a charge carrier has a uniform electrostatic charge applied to it. Thereafter, an image of an original is formed on this surface (usually projected onto it) by an appropriate optical system. This discharges the surface areas in accordance with the intensity of the radiation that reaches them and thus forms on the surface a latent electrostatic image.

To develop this image a dry, pulverulent developer material is applied to the surface to which it adheres electrostatically, in accordance with the latent electrostatic image, so as to form an actual visible image on the surface. This visible image is then transferred to a copy carrier, e.g. a sheet of paper or the like, by contacting the charge carrier surface with a copy carrier and transferring the developer particles to the copy carrier. Finally, the actual image which is now present on the copy carrier, must be fixed thereon to prevent the developer particles from rubbing off with a resultant destruction of the image.

This entire process is well known in the art and discussed in detail, e.g. in U.S. Pat. No. 3,062,109 of C. R. Mayo et al, to which reference may be had.

A proposal for eliminating the image transfer from the charge carrier to the copy carrier has been made in German Published Application No. (OS) 2,418,240. According to this proposal the latent electrostatic image is produced on a surface of a durable, inexpensive charge carrier of, e.g. Se, $As_2$, $Se_3$ or CdS. The surface is then contacted with a copy carrier and the image is thereafter developed directly on the copy carrier instead of on the charge carrier, so that no image transfer is required. The copy carrier itself is not required to be photoconductive.

Furthermore, the developer contacts only the copy carrier and not the charge carrier in this proposal. This makes it possible to use a liquid developer (i.e. a liquid carrier having toner particles suspended in it) or to employ electrophoretic development, both of which produce superior images and are best suited for making half-tone reproductions.

Theoretically, liquid developer could of course also be used with the conventional electrophotographic copiers described in the introductory paragraphs. However, this is not done because it has certain disadvantages. The transfer of a liquid-developed image from the charge carrier to the copy carrier is difficult and will, as a rule, result in a deterioration of the image. Moreover, the frequent contact of the developer liquid (and the substances dissolved therein) with the photoconductive surface of the charge carrier causes this surface in time to undergo changes which undesirably change its characteristics. Also, the drying and/or wiping of the photoconductive charge carrier surface, which must be carried out subsequent to developing of the latent image, cause a rapid wear of the surface.

All of these problems are avoided in the second proposal mentioned above, which thus constitutes an important advance in the art. However, it has been found that further improvements are desirable, inasmuch as the contacting of the charge carrier surface with the copy carrier tends to damage or at least weaken the latent electrostatic image which is present on the charge carrier surface.

SUMMARY OF THE INVENTION

Accordingly, it is an object of the present invention to provide such improvements.

More particularly, it is an object of the invention to provide an improved apparatus for making electrophotographic copies.

Another object of the invention is to provide such an apparatus which is capable of producing high-quality copies, even half-tone copies, utilizing any type of developing but being especially well adapted for the use of liquid developer.

A concomitant object is to provide such an apparatus in which even sensitive photoconductive charge carriers, such as selenium, selenium compounds, and the like, will not be damaged if liquid developer is used.

Still a further object is to provide such an apparatus in which the conventional transfer of the image from the charge carrier to the copy carrier, as well as the subsequent cleaning of the charge carrier to remove residual toner particles, is eliminated and the charge carrier surface is subjected to only negligible mechanical forces.

Yet an additional object is to provide such an apparatus wherein the latent electrostatic image undergoes no deterioration prior to or during its developing.

It is also an object of the invention to provide an improved electrophotographic copying method offering the above-summarized advantages.

Pursuant to the above objects, and still others which will become apparent hereafter, one feature of the invention resides in a method of electrophotographic copying. Briefly stated, this method may comprise the steps of applying an electrostatic charge to a charge carrier, contacting the charge carrier with a copy carrier, imaging an original onto the charge carrier so as to produce thereon a latent electrostatic image field which penetrates the copy carrier, and developing the latent image on the copy carrier to produce an actual visible image on the same.

The apparatus for carrying out the method may comprise a charge carrier having an electrostatically chargeable surface, means for applying to the surface one side of a flexible sheet-material copy carrier, means for forming latent electrostatic image of an original on the surface upon application of the copy carrier to the surface, so that the latent electrostatic image penetrates the copy carrier, and means for developing the latent image on an opposite side of the copy carrier to produce an actual visible image on the opposite side.

The copy carrier may be transparent and the image of the original may be projected through the copy carrier onto the charge carrier. However, it is also possible to make the charge carrier transparent and to project the image through the transparent charge carrier onto the photoconductive surface thereof; in this case the copy carrier may of course be opaque, although a transparent copy carrier can also be used.

The central aspect of the invention is that the latent electrostatic image is produced on the photoconductive surface of the charge carrier only after this surface has come into contact with the copy carrier. This eliminates any possibility that the latent image might be damaged, weakened or otherwise degraded by the contacting process and assures a sharp image of high quality.

Since the latent image is developed not on the charge carrier, but on the copy carrier directly, the prior-art image transfer is eliminated. Furthermore, all prior-art cleaning of the charge carrier surface is obviated, so that deterioration of the charge carrier surface due to such cleaning is avoided and the life of the charge carrier surface is significantly increased.

The copy carrier may be constituted of a foil (web or sheet) of polyethylene terephthalate (PET), cellulose acetate, polyethylene (PE), polypropylene, polyvinylchloride (PVC) or polycarbonate. Its thickness in that case may be on the order of between about 5 and 25 microns. Such foils are all readily commercially available.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
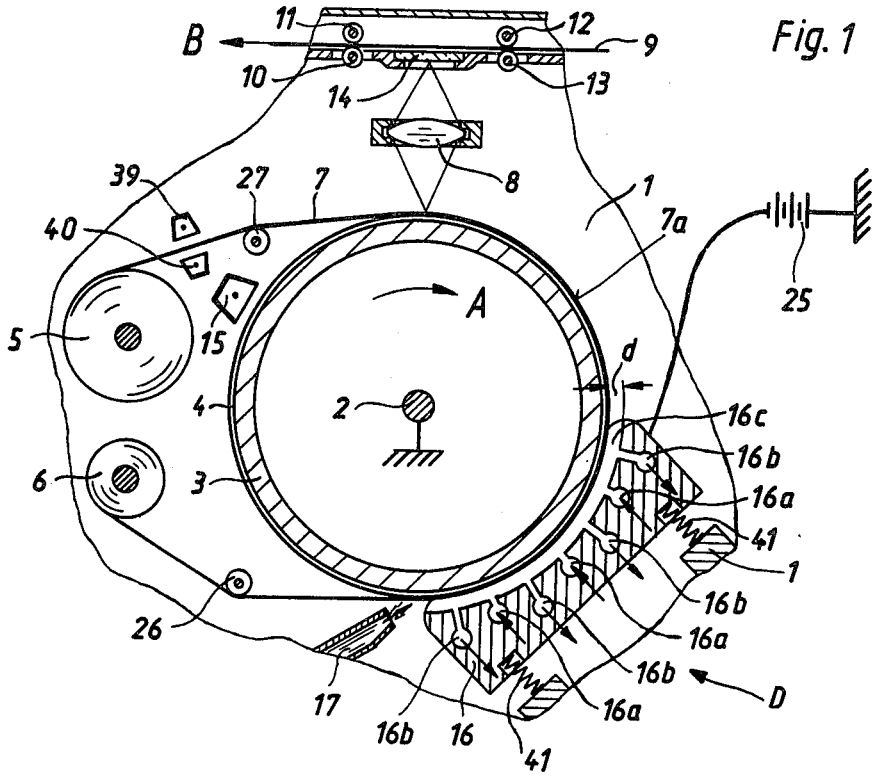
FIG. 1 is a fragmentary section through an electrophotographic copying apparatus embodying the invention.

The apparatus and method according to the invention will hereafter be discussed jointly, with reference to the drawing.

FIG. 1 of the drawing shows an embodiment of the apparatus where a (only diagrammatically shown) machine frame or machine housing 1 supports the shaft 2 of a drum-shaped charge carrier 3, which is driven by any well-known drive (not shown) to rotate in the direction of arrow A during the copying operation. Drum 3 is provided on its outer circumferential surface with a photoconductive layer 4 (e.g. Se) in the manner known in this art.

The copy carrier in this embodiment is in form of an elongated, transparent web 7 constituted of one of the previously mentioned materials. A supply of the web 7 is coiled on a pay-out roll 5 from which it can be drawn to be wound up onto a take-up roll 6. Both of the rolls 5, 6 are turnably journalled on the frame 1 and at least the roll 6 is provided with any well-known drive (not shown) which rotates it in take-up direction (i.e. clockwise in this embodiment). Intermediate the rolls 5, 6 the web is guided into contact with the surface 4 of drum 3 by means of web-guiding rollers 26, 27.

The original 9 (i.e. any material or subject matter to be reproduced) is placed face down onto a transparent support plate 14 of, e.g. glass or synthetic plastic. Pairs of driven nip rollers 10, 11 and 12, 13 engage the original 19 and advance it on the plate 14 in the direction of arrow B at a predetermined speed which, if the copy ratio is to be 1:1, corresponds to the peripheral speed of the drum 3. An optical (lens) system 8 is provided which images the original and projects an image thereof onto the drum surface 4 at a location at which the web 7 is already in contact with the drum surface.

To remove any electrostatic charge which might still be present on the surfaces of web 7 from a preceding copy cycle, a pair of corona discharge devices 39, 40 (known per se) is provided intermediate the pay-out roll 5 and the drum 3; the web passes between these devices, as shown.

In order for the optical system 8 to be able to produce a latent electrostatic image on the surface 4 of drum 3, the surface 4 must first receive a uniform electrostatic charge. For this purpose another (known per se) corona discharge device 15 is provided in the machine, so positioned as to impart the requisite electrostatic charge to the surface 4 before the same is contacted by the web 7. The subsequent projection of an image onto the surface 4 (through the transparent web) then results in known manner in the formation thereon of a latent electrostatic image corresponding to the image projected by the system 8. It is important to remember that this latent image, i.e. the electrostatic fields which make up the image, penetrate through the thin web 7 to its outer side, i.e. to the side which faces away from the surface 4 of drum 3. Thus, the latent electrostatic image is simultaneously present on the outer side of web 7 as well as on the drum surface 4. It can, therefore, be developed directly on the outer surface of the web 7.

This takes place as the web 7 continues to move with the rotating drum 3 in the direction of the arrow A, so that the web increment having the latent image arrives at a developing station. There, a developer applying device D (which may, e.g. be similar to those disclosed in German Published Application No. 2,417,721) directs developer material against the outer side of the web 7. The developer may be dry and pulverulent, as is common in the art, or developer particles might be entrained in a stream of gaseous fluid that is directed against the outer side of the web 7. Currently preferred, however, is the use of a liquid developer, i.e. a liquid carrier in which developer (toner) particles are suspended. These particles are attracted and adhere to the outer side of web 7 in a pattern and density corresponding to the latent electrostatic image, thus forming on the web an actual visible image. The device D may have a metallic body 16, which is urged by springs 41 towards the drum 3, so that edges of the body 16 which bound a depression are in sliding (and sealing) contact with the outer side of web 7. Thus, a developing space **16*c* is defined between this outer side and the body 16, having a depth d which is always precisely maintained. The body 16 has a plurality of inflow passages 16*a* which communicate (not shown) with a reservoir of developing liquid via conduit means and e.g. a pump. The developing liquid flows from passages 16*a* into the space 16*c*, contacts the web 7 and then flows out again via outflow passages 16*b* of the body 16**.

Body 16 may be connected to ground potential or, as shown, to a voltage source 25 so that it acts as a developer electrode which accelerates the deposition of toner particles from the developing liquid onto the web 7. It is for this reason that the distance d must always be maintained with precision. The distance d should not exceed about 0.5 mm, and may be selected as small as some hundredth of a millimeter.

It is self-evident that the proper operation of the invention depends upon adequate penetration of the electrostatic field (of the latent image) from surface 3 through web 7 and into the space 16c. The proportion of the field which is effective for developing purposes (i.e. extends beyond the outer side of web 7) depends upon the thickness of web 7, the penetration resistance offered to the field by the web 7, and the distance d between the web and the surface of body 16 which bounds the space 16c. It follows from this that the efficiency of development will be beneficially influenced if the web 7 is thin and offers relatively little resistance to penetration by the field, and if the distance d is small. Evidently, these optimum requirements must be tempered by the need for the web 7 to have sufficient mechanical strength, and to have enough field penetration resistance to prevent dissipation of the field (and destruction of the latent image) before the developing station is reached. The distance d, on the other hand, can be made only so small as is consistent with the need for the space 16c to permit an adequate flow of developer liquid.

These somewhat contradictory requirements are met if the thickness of web 7 is between about 5 and 50 micron, preferably between about 5 and 25 micron. The web will then have adequate mechanical strength whereas the electrostatic field can penetrate adequately through it. The specific penetration resistance of the web should be in excess of $10^{10}\Omega$ cm, preferably about $10^{12}$ and $10^{14}\Omega$ cm.

Once the latent image has been developed on the outer surface of web 7 at the station D, the continued rotation of drum 3 and advancement of web 7 with it moves the web increment carrying the developed image past a nozzle 17 at which a blast of warm air dries the web and fixes the image. Thereafter the web with the image thereon is wound onto the take-up roll 6. The next copy cycle can then begin.

Figure 2:
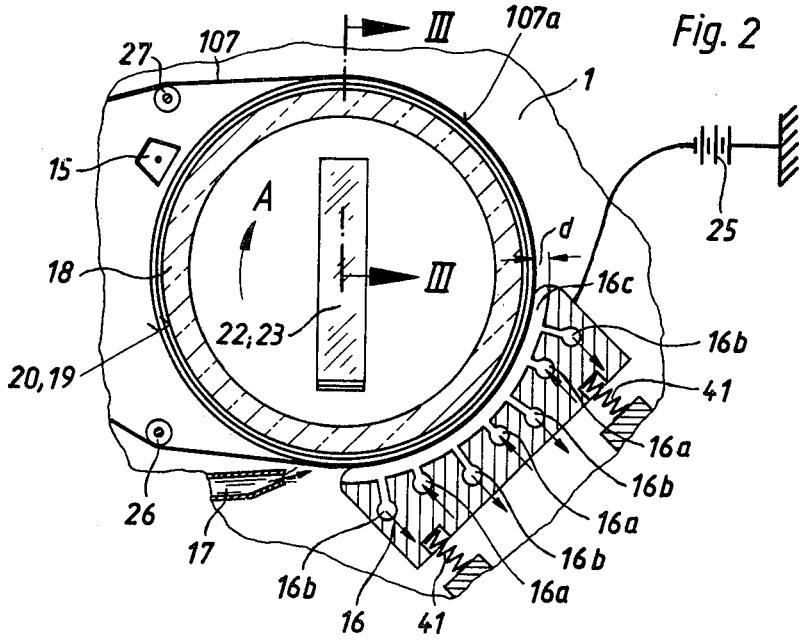
FIG. 2 is a view similar to FIG. 1 but illustrating an embodiment having a transparent charge carrier.
Figure 3:
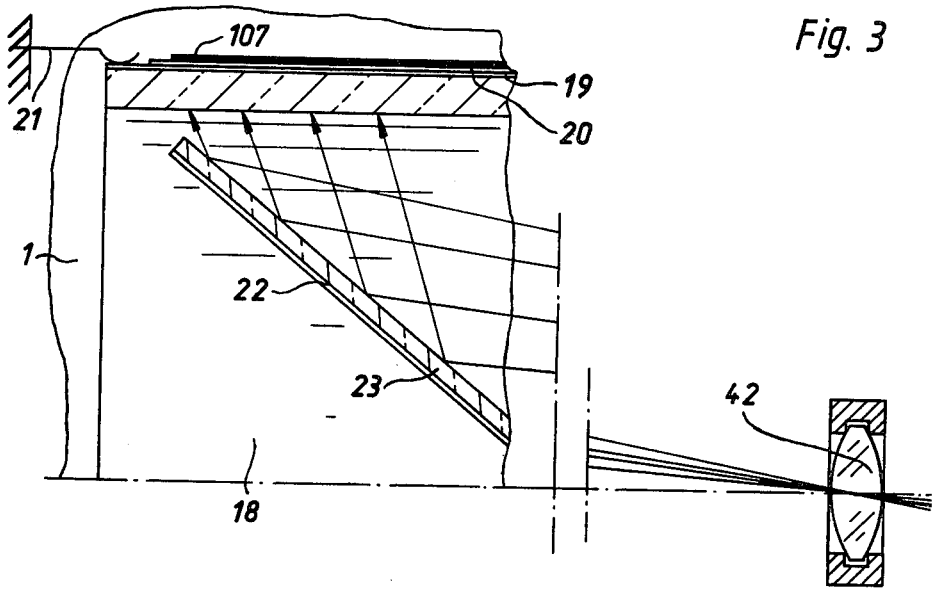
FIG. 3 is a fragmentary section on line III—III of FIG. 2.

The embodiment in FIGS. 2 and 3 differs from the one in FIG. 1 mainly in that it utilizes a transparent charge carrier in form of a glass drum 18. The outer surface of the drum 18 is coated with an electrically conductive material (e.g. cassiterite=$SnO_2$, or gold) in a layer which is so thin that it is transparent. Such layers may be formed by e.g. vacuum deposition and it is well known that they can be made thin enough to be transparent. A photoconductive layer 20 (e.g. of Se, $As_2Se_3$, CdS or the like) is applied over the layer 19. The latter projects (at least at one end of the drum 18) somewhat beyond the layer 20 (see FIG. 3) so that it may be contacted by a sliding resilient arm 21 or the like. This is to assure that the uniformly charged layer 20 (see corona device 15) can be discharged via the layer 19 and the contact 21 during formation of, and in keeping with, the latent electrostatic image. The polarity of the original charge (via device 15) must be so selected that maximum sensitivity of the layer 20 is obtained, given the fact that the moving layer 20 will be imaged from the inside of drum 18.

To make such imaging from inside the drum 3 possible, a deflecting mirror 23 is mounted within the drum 18 on a carrier 22. The optical (lens) system 42 is mounted outside the drum 18 but located on the longitudinal axis of the same. The original to be copied may be mounted on a cylinder which rotates in synchronism with the drum 18 (not shown, but well known per se), in which case the lens system 42 will reproduce the image of the original in a sequence of successive strips on the inner side of layer 20, by projecting the light rays onto the mirror 23 which deflects them through the wall of drum 18 and through the layer 19 onto the layer 20. The resulting latent electrostatic image will, of course, again be produced on an area of the drum 18 which is already in contact with the copy carrier 107 before the image is formed. Carrier 107 may be transparent, but can equally well be opaque. If it is e.g. white, the developed image on it may be viewed under incident light, as if it were a paper copy.

As in the preceding embodiment, the latent electrostatic image is again developed by contacting the outer side 107a of the web 107 with the developer, preferably liquid developer, using the same type of device D as described in FIG. 1.

Figure 4:
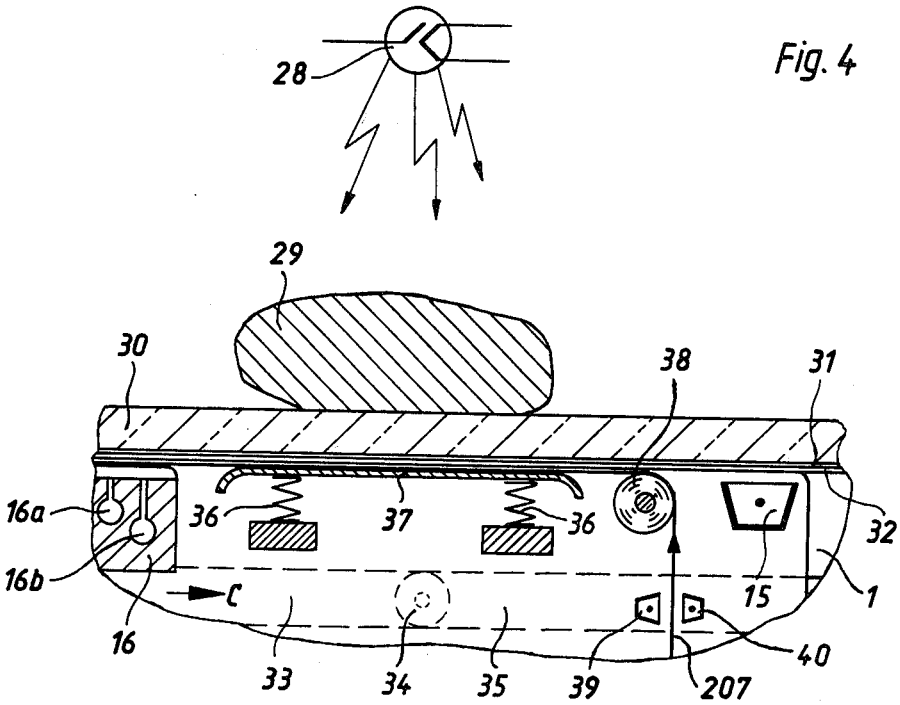
FIG. 4 is a fragmentary section, showing a further embodiment of the apparatus according to the present invention.

FIG. 4, finally, shows an embodiment which is particularly suited for radiographic purposes. Like reference numerals identify the same components as in the preceding embodiments. Here, the original 29 (i.e. an object whose interior is to be examined by means of X-rays) is placed onto the upper side of a plate 30 of glass or another suitable transparent substance. The lower side of plate 30 is coated with an electrically conductive layer 31 over which a photoconductive layer 32 is applied. Materials suitable for these layers were discussed in connection with FIGS. 2 and 3. The layer 31 is grounded with a slip contact which engages one of its edges, as described with reference to contact 21 in FIG. 3.

A carriage 33 is mounted via rollers 34 (one shown) on rails 35 (one shown) of the machine frame 1, so that it can move in, and counter to, the direction of arrow C. The corona device 15 for charging the layer 32 is mounted on carriage 33, together with the developing device 16 and the (not shown) drying device 17. In addition the carriage 33 has mounted on it a pay-out roller and a take-up roller (not shown, but similar to 5, 6 in FIG. 1) for a copy carrier or web 207 which corresponds to any of the webs discussed in connection with the preceding embodiments. Here, as in the embodiment of FIGS. 2–3, the web 207 may be opaque (but could be transparent), since the X-ray image can readily penetrate it. Web 38 is guided by one or more rollers 38 (one shown) to pass beneath the layer 32 of plate 30. After being pulled off the pay-out roll it passes in the indicated direction between the corona discharge devices 39, 40 which remove any residual electrostatic charges on it.

When carriage 33 is moved in the direction of arrow C the corona device 15 applies a uniform electrostatic charge to the layer 32. Behind the device 15 an increment of the web 207 is pressed lightly against the layer 32 by a contact member 37 which is biased by springs 36. As soon as the increment is fully located beneath the layer 32, an X-ray source 28 located opposite the plate 30 is energized for a period of time required to produce a latent electrostatic image on the layer 32. The exact time can be readily empirically determined and the latent image so formed will show the interior of the object 29, e.g. it will reveal cracks, voids or the like which may be present in the object.

Upon elapse of this time, i.e. once the latent electrostatic image has been formed, the carriage 33 is advanced further in the direction C so that the device 16 now moves beneath that increment of web 207 which is located under the plate 30 on the layer 32 of which the latent image is formed. The device 16 then develops the latent image by applying developer to the web increment beneath the layer 32 in the manner described with reference to the preceding embodiments. After developing and drying is completed, a length of the web 207 corresponding to the length of the increment bearing the developed image, is taken up onto the take-up roll (the direction of web movement is indicated by an arrowhead) and the carriage 33 if moved back to its starting position counter to the arrow C. Of course, it must be remembered that during the movements of the carriage 33 the take-up and pay-out rolls for the web 207 must be so driven that the web 207 remains stationary relative to the layers 31, 32; drive means for this purpose are known per se and therefore require no detailed discussion.

In the several embodiments it would, of course, be possible to use for each image a sheet-like copy carrier instead of the illustrated web-like copy carrier. In that case the pay-out and take-up rollers could be omitted and appropriate (known-per-se) transporting means (e.g. pairs of nip rollers) be provided to transport the sheet-like copy carriers from a supply to the exposure and developing stations and from there to a copy receptacle.

While the invention has been illustrated and described as embodied in an electrophotographic copier, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In an electrophotographic copying apparatus, a combination comprising a charge carrier plate of transparent material having an electrostatically chargeable surface; means for applying to said surface one side of a flexible sheet-material copy carrier; means for forming a latent electrostatic image of an original on said surface upon application of the copy carrier to the surface, so that the latent electrostatic image penetrates the copy carrier; means for developing the latent image on an opposite side of the copy carrier to produce an actual visible image on said opposite side; a carriage movable along said surface and carrying said means for developing; and a corona charging device also carried by said carriage for applying a uniform electrostatic charge to said surface.

2. A combination as defined in claim 1, said means for applying including biasing means for biasing increments of said copy carrier against said surface.

3. A combination as defined in claim 1, said means for forming comprising an X-ray source adjacent to but spaced from another surface of said plate which faces away from said chargeable surface.

4. A combination as defined in claim 3, wherein said other surface of said plate constitutes a support for the original.

5. A combination as defined in claim 1, wherein said means for developing comprises a device for contacting said copy carrier with a liquid developer.

6. A combination as defined in claim 1, wherein said means for developing comprises a device for applying to said opposite side of said copy carrier a stream of developing fluid.

7. A combination as defined in claim 1, wherein said means for developing comprises a device for contacting said opposite side of said copy carrier with a developing liquid.

8. A combination as defined in claim 7; and further comprising means for drying said opposite side of said copy carrier subsequent to contacting thereof with the developing liquid.

* * * * *